US008580726B2

(12) United States Patent
Barreleiro et al.

(10) Patent No.: US 8,580,726 B2
(45) **Date of Patent: *Nov. 12, 2013**

(54) COLOR-PROTECTING WASHING OR CLEANING AGENT

(75) Inventors: Paula Barreleiro, Dusseldorf (DE); Thomas Eiting, Dusseldorf (DE); Andreas Taden, Dusseldorf (DE); Siglinde Erpenbach, Monheim (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 67 days.

This patent is subject to a terminal disclaimer.

(21) Appl. No.: 13/292,544

(22) Filed: Nov. 9, 2011

(65) Prior Publication Data

US 2012/0047664 A1 Mar. 1, 2012

Related U.S. Application Data

(63) Continuation of application No. PCT/EP2010/056175, filed on May 6, 2010.

(30) Foreign Application Priority Data

May 12, 2009 (DE) ..... 10 2009 003 034

(51) Int. Cl.
*C11D 3/28* (2006.01)

(52) U.S. Cl.
USPC ..... 510/330; 510/360; 510/475; 510/499; 510/505; 8/137

(58) Field of Classification Search
USPC ..... 510/330, 360, 475, 499, 505; 8/137
See application file for complete search history.

(56) References Cited

U.S. PATENT DOCUMENTS

| | | | | |
|---|---|---|---|---|
| 5,543,516 | A | 8/1996 | Ishida | |
| 5,755,992 | A | 5/1998 | Jeffrey et al. | |
| 8,309,066 | B2 * | 11/2012 | Taden et al. | 424/70.11 |
| 2007/0141426 | A1 * | 6/2007 | Choi et al. | 429/33 |

FOREIGN PATENT DOCUMENTS

| | | | |
|---|---|---|---|
| EP | 0176011 | B1 | 1/1992 |
| WO | WO 95/27773 | * | 10/1995 |

OTHER PUBLICATIONS

Garea et al, A new strategy for polybenzoxazine montmorillonite nanocomposites synthesis, Polymer Testing 28, pp. 338-347, Feb. 2009.*

PCT International Search Report (PCT/EP2010/056175) dated Jan. 9, 2010.

Torregrosa et al, "Isoprene-catalyzed lithiation of imidazole: synthesis of 2-(hydroxyalkyl)- and 2-(aminoalkyl)imidazoles", Tetrahedron 2005, vol. 61, pp. 11148-11155.

Thieme et al, Houben-Weyl, Methoden der organischen Chemie, 1992, vol. E16d, pp. 755-770.

* cited by examiner

*Primary Examiner* — Brian P Mruk
(74) *Attorney, Agent, or Firm* — Thomas G. Krivulka

(57) ABSTRACT

The invention relates to washing and cleaning agents for washing or cleaning colored textile surface structures, used for improving the color-fastness thereof. The aim was substantially met by adding polymers obtained by the polymerization of benzoxazine monomers to the agent.

5 Claims, No Drawings

COLOR-PROTECTING WASHING OR CLEANING AGENT

CROSS-REFERENCES TO RELATED APPLICATIONS

This application is a continuation of PCT/EP2010/056175, filed on May 6, 2010, which claims priority under 35 U.S.C. §119 to DE 10 2009 003 034.4 filed on May 12, 2009, both of which are hereby incorporated by reference.

FIELD OF THE INVENTION

The present invention generally relates to the use of polymers that are available by polymerizing benzoxazines as color transfer inhibitors for washing and/or cleaning textiles, as well as washing and cleaning agents that comprise these types of color transfer inhibiting polymers.

BACKGROUND OF THE INVENTION

Besides the indispensable ingredients, such as surfactants and builders for the washing or cleaning process, washing and cleaning agents generally comprise further constituents that can be summarized by the term detergent auxiliaries and which include the different active substances such as foam regulators, graying inhibitors, bleaching agents, bleach activators and enzymes. These types of auxiliaries also include substances that are intended to prevent dyed textile fabrics acquiring a modified color impression when washed. This color impression modification of washed, i.e. cleaner textiles can be based firstly on the fact that fractions of dye are removed from the textile by the washing or cleaning process ("fading"), secondly that dyes detached from differently colored textiles can be deposited on the textile ("discoloration"). Discoloration can also occur with un-dyed laundry articles when these are washed together with colored laundry articles. In order to prevent these unwanted side effects of the soil removal from textiles during treatment with typical surfactant-containing aqueous systems, washing agents, in particular when they are so-called washing agents for colored textiles, intended for washing colored textiles, comprise active substances that prevent the removal of dyes from the textile or at least should avoid any removed dyes that are present in the wash liquor from being deposited on textiles. Many of the polymers that are typically used however, have such a high affinity to dyes that they strongly remove the dyes from the colored fibers, with the result that their use leads to color losses. The same also applies when cleaning hard surfaces.

It has now been surprisingly found that benzoxazine polymers afford unexpectedly high color transfer inhibition when they are used in washing or cleaning agents. The prevention of staining of white or even differently colored textiles by dyes that are washed out of textiles is particularly pronounced. It is conceivable that the benzoxazine polymers (described in more detail below) become attached to the textiles being washed and thereby on the one hand effectively prevent the removal of the dye from the textiles, and on the other hand repel the dye molecules that are already present in the wash liquor.

The subject matter of the invention are polymers, obtainable by polymerizing benzoxazine monomers, used to avoid the transfer of textile dyes from dyed textiles onto un-dyed or differently colored textiles when they are washed together in, in particular surfactant-containing aqueous solutions.

Furthermore, other desirable features and characteristics of the present invention will become apparent from the subsequent detailed description of the invention and the appended claims, taken in conjunction with this background of the invention.

BRIEF SUMMARY OF THE INVENTION

Effective agents for the inhibition of the transfer of textile dyes from dyed textiles onto un-dyed or differently colored textiles during washing are provided. The agents comprise color transfer inhibitors in the form of polymers, obtainable by polymerizing benzoxazine monomers.

A process is provided for washing textiles in surfactant-containing aqueous solutions. The process comprises a surfactant-containing aqueous solution that comprises a polymer, obtained by polymerizing benzoxazine monomers.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The benzoxazine polymers of the present invention can be obtained in a fundamentally known manner by polymerizing benzoxazines. The benzoxazine compounds that can be used for manufacturing the benzoxazine polymers are polymerizable monomers that contain at least one benzoxazine group. Preferred monomers can preferably contain up to four benzoxazine groups, wherein both individual monomers as well as mixtures of two or more monomers can be used for manufacturing inventively used benzoxazine polymers. The polymerizable benzoxazine compound (for the benzoxazine polymer) or the mixture of different polymerizable benzoxazine compounds (for the benzoxazine copolymer) can be polymerized by means of in principle, known processes, for example at increased temperatures according to a self-initiating mechanism (thermal polymerization) or by adding cationic initiators. Suitable exemplary cationic initiators are Lewis acids or other cationic initiators, such as for example metal halides, organometallic reagents, such as metalloporphyrins, methyl tosylates, methyl triflates or trifluorosulfonic acids. Basic reagents can also be used for initiating the polymerization of the polymerizable benzoxazine compound or the mixture of different polymerizable benzoxazine compounds. Suitable exemplary basic reagents can be selected from imidazole or imidazole derivatives. The thermal polymerization is generally carried out at temperatures of 150° C. to 300° C., in particular at temperatures of 160° C. to 220° C. The polymerization temperature can also be lower when the above-mentioned initiators and/or other reagents are used. The polymerization process is essentially based on the thermally induced ring opening of the oxazine ring of a benzoxazine system.

In a preferred embodiment of the present invention, the polymerizable benzoxazine compound is selected from compounds of the general Formula (I) or from compounds of the general Formula (II)

Formula (I)

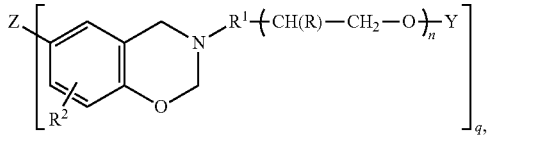

-continued

Formula (II)

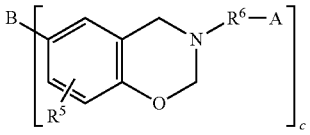

or from mixtures thereof, wherein q is a whole number from 1 to 4, n is a number from 2 to 20 000, preferably from 3 to 10 000, more preferably from 4 to 8000 and especially from 5 to 7000, R in each repeat unit is selected independently of each other from hydrogen or linear or branched, optionally substituted alkyl groups that contain 1 to 8 carbon atoms, Z is selected from hydrogen (for q=1), alkyl (for q=1), alkylene (for q=2 to 4), carbonyl (for q=2), oxygen (for q=2), sulfur (for q=2), sulfoxide (for q=2), sulfone (for q=2) and a direct, covalent bond (for q=2), $R^1$ stands for a covalent bond or a divalent linking group that contains 1 to 100 carbon atoms, $R^2$ is selected from hydrogen, halogen, alkyl and alkenyl, or $R^2$ is a divalent group that makes a corresponding naphthoxazine structure from the benzoxazine structure, Y is selected from linear or branched, optionally substituted alkyl groups that contain 1 to 15 carbon atoms, cycloaliphatic groups that optionally comprise one or more heteroatoms, aryl groups that optionally comprise one or more heteroatoms, and —(C═O)$R^3$, wherein $R^3$ is selected from linear or branched, optionally substituted alkyl groups containing 1 to 15 carbon atoms and X—$R^4$, wherein X is selected from S, O, and NH and $R^4$ is selected from linear or branched, optionally substituted alkyl groups containing 1 to 15 carbon atoms, c is a whole number from 1 to 4, B is selected from hydrogen (for c=1), alkyl (for c=1), alkylene (for c=2 to 4), carbonyl (for c=2), oxygen (for c=2), sulfur (for c=2), sulfoxide (for c=2), sulfone (for c=2) and a direct, covalent bond (for c=2), A is a hydroxyl group or a nitrogen-containing heterocycle, $R^5$ is selected from hydrogen, halogen, alkyl and alkenyl, or $R^5$ is a divalent group that makes a corresponding naphthoxazine structure from the benzoxazine structure and $R^6$ stands for a covalent bond or is a divalent linking group that contains 1 to 100 carbon atoms.

In an embodiment of the invention, R in Formula (I) in each repeat unit is selected independently of each other from hydrogen and methyl.

The divalent organic linking groups $R^1$ in Formula (I) and/or $R^6$ in Formula (II) preferably contain 2 to 50, particularly preferably 2 to 25 and especially 2 to 20 carbon atoms. In addition, each divalent organic linking group $R^1$ and $R^6$ can be selected from linear or branched, optionally substituted alkylene groups that contain 1 to 15 carbon atoms, wherein the alkylene groups are optionally interrupted by at least one heteroatom, selected from oxygen, sulfur or nitrogen. In the context of the present invention, the term "interrupted" is understood to mean that in a divalent alkylene group, at least one non-terminal carbon atom of said group is replaced by a heteroatom, wherein the heteroatom is preferably selected from —S—(sulfur), —O—(oxygen), and —$NR^a$—(nitrogen), wherein $R^a$ stands in particular for hydrogen or for a linear or branched, optionally substituted alkyl group containing 1 to 15 carbon atoms. The divalent organic compound groups $R^1$ and/or $R^6$ are preferably selected from alkylene groups that contain 2 to 8 carbon atoms. In a preferred embodiment, $R^1$ and/or $R^6$ are selected from linear alkylene groups that comprise 2 to 6, especially 2 or 3 carbon atoms, such as for example ethylene, propylene, butylene, pentylene and hexylene groups. Alternatively, $R^1$ in Formula (I) and/or $R^6$ in Formula (II) can stand for a covalent bond.

Moreover, the divalent organic compound groups $R^1$ and/or $R^6$ can contain at least one arylene group and/or at least one biphenylene group, each preferably containing 6 to 12 carbon atoms. The arylene groups and biphenylene groups can be substituted or unsubstituted, wherein suitable substituents are selected for example from alkyl, alkenyl, halogen, amine, thiol, carboxyl and hydroxyl groups. In addition, at least one carbon atom of the aromatic ring system of the cited groups can be replaced by a heteroatom, wherein the heteroatom is preferably selected from oxygen, nitrogen and sulphur.

The groups $R^2$ and $R^5$ in Formula (I) and Formula (II) preferably each stand for hydrogen and methyl.

The A group in Formula (II) stands for a hydroxyl group or a nitrogen-containing heterocycle. In the context of the present invention, the term "nitrogen-containing heterocycle" is understood to mean particularly those ring systems that comprise 3 to 8 ring atoms, preferably 5 to 6 ring atoms, wherein the ring system includes at least one nitrogen atom and at least two carbon atoms. Said nitrogen-containing heterocycle can have a saturated, unsaturated or aromatic structure and can also include additional heteroatoms, such as for example sulfur and/or oxygen atoms, in addition to the above-mentioned atoms. In accordance with Formula (II), the nitrogen-containing heterocycle is linked through the linking group $R^6$ with the nitrogen atom of the oxazine ring of the benzoxazine structure. The divalent linking group $R^6$ can be linked with each nitrogen or carbon ring atom of the nitrogen-containing heterocycle, in which $R^6$ formally replaces a hydrogen atom that is covalently bonded to a nitrogen or carbon ring atom. Exemplary particularly preferred nitrogen-containing heterocycles are selected from 5-membered nitrogen heterocycles, such as for example imidazoles, imidazolidones, tetrazoles, oxazoles, pyrroles, pyrrolidines and pyrazoles or 6-membered nitrogen-containing heterocycles, such as for example piperidines, piperidones, piperazines, pyridines, diazines and morpholines.

In a preferred embodiment of the invention, the polymerizable benzoxazine compounds of the general Formula (I) are selected from compounds of the general Formula (III), Formula (III)

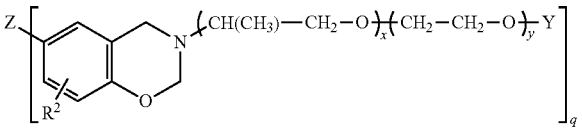

wherein x is a number between 0 and 1000 and y is a number between 0 and 1000, with the proviso that x+y≥2, wherein Z, $R^2$, Y and q are each defined as above in Formula (I). Preferably, x+y≥3, particularly preferably ≥4 and quite particularly preferably ≥5.

Depending on the application profile it can be advantageous to adjust the number of the alkylene oxide units of the alkylene oxide chain in the polymerizable benzoxazine compound of the general Formula (I) and (III). In specific embodiments of the invention, n or x+y therefore assumes as a lower limit a value of at least 3, 4, 6, 10, 12, 14, 16, 18, 20, 25, 30, 35, 40, 50, 60, 80, 100, 150 or 200. In the inventive benzoxazine compounds of the general Formula (I) or (III), an advantageous upper limit for n and/or x+y is preferably at a value of maximum 10 000, 2000, 1800, 1600, 1400, 1200, 1000, 800, 600 or 400.

In another preferred embodiment of the invention, the benzoxazine compounds of the general Formula (II) are selected from compounds of the general Formula (IV) and/or from compounds of the general Formula (V), Formula (IV)

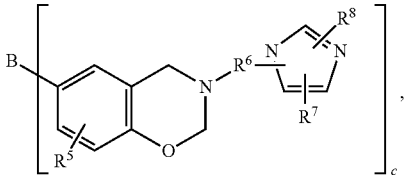

Formula (V)

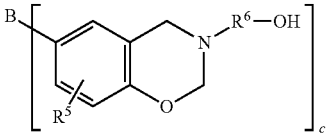

wherein $R^7$ and $R^8$ each independently of one another are selected from hydrogen, halogen, linear or branched, optionally substituted alkyl groups, alkenyl groups and aryl groups, wherein c, B, $R^5$ and $R^6$ are each as defined above as in Formula (II).

In another embodiment of the invention, $R^7$ and $R^8$ in Formula (IV) are selected independently of one another from hydrogen, methyl, ethyl, n-propyl, iso-propyl, n-butyl, sec-butyl and iso-butyl, wherein $R^7$ and $R^8$ stand in particular for hydrogen or methyl.

Particularly preferred benzoxazine compounds of the general Formula (IV) are selected from the following benzoxazine compounds:

(B-I)

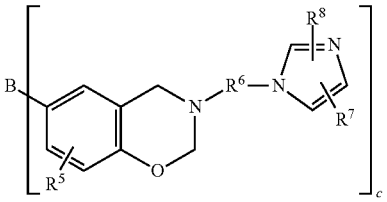

(B-II)

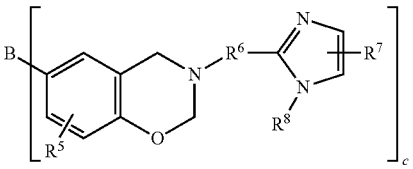

wherein c, B, $R^5$, $R^6$, $R^7$ and $R^8$ are defined as above.

Specific benzoxazine compounds of the general Formula (IV) can be selected for example from the following compounds:

(B-III)

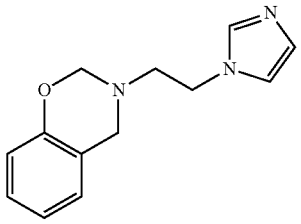

(B-IV)

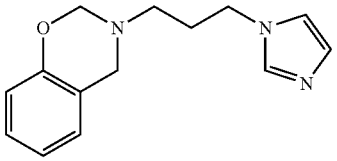

(B-V)

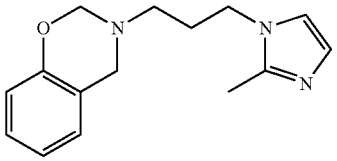

(B-VI)

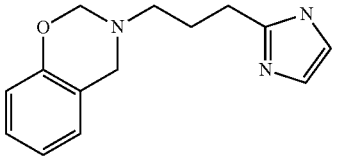

(B-VII)

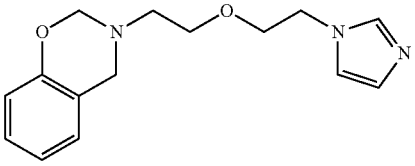

(B-XVII)

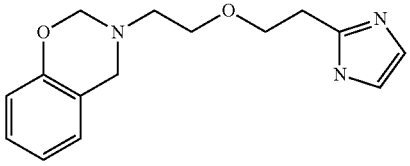

(B-VIII)

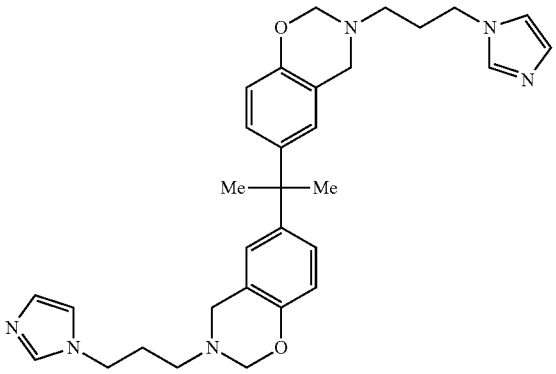

The illustrated benzoxazine compounds that carry an imidazole ring as the nitrogen-containing heterocycle can be obtained for example by treating a phenolic compound with an aldehyde, such as for example formaldehyde and an aminoalkyl-imidazole compound. Exemplary suitable phenolic compounds can be selected from mono or bisphenolic compounds, such as for example phenol, Bisphenol A, Bisphenol F, Bisphenol S or thiodiphenol. Besides formaldehyde, paraformaldehyde, trioxane or polyoxymethylene or any of their mixtures can also be used as the aldehyde.

Preferred aminoalkyl-imidazole compounds have in particular a primary amino group and can be selected for example from compounds of the general Formula (VI), Formula (VI)

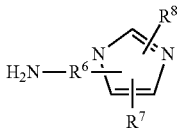

wherein $R^6$, $R^7$ and $R^8$ are as described above.

In particular, 1-aminoalkyl-imidazole compounds of the general Formula (VII),

Formula (VII)

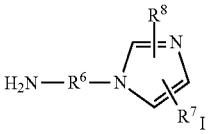

or 2-aminoalkyl-imidazole compounds of the general Formula (VIII)

Formula (VIII)

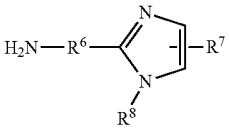

are suitable for manufacturing the corresponding benzoxazine compounds, wherein $R^6$, $R^7$ and $R^8$ are as defined above.

Suitable 1-aminoalkyl-imidazole compounds of the general Formula (VII) are known from the prior art and are commercially available. Examples are for example 1-(3-aminopropyl)imidazole, available under the trade name Lupragen® API from BASF SE, 3-imidazo 1-yl-2-methylpropylamine (ChemPacific), 2-methyl-1H-imidazole-1-propanamine (3B Scientific Corporation), 3-imidazol-1-yl-2-hydroxypropylamine (Ambinter, Paris Collection), 1-(4-aminobutyl)imidazole (Ambinter, Paris Collection), 2-ethyl-1H-imidazole-1-propanamine (ChemBridge Corp.). Besides the use of commercially available 1-aminoalkyl-imidazole compounds of the general Formula (VII), they can also be manufactured using well established synthetic organic methods, such as for example by a process that is described in Houben-Weyl, Methoden der organischen Chemie Vol. E 16d, Georg-Thieme-Verlag Stuttgart, 1992, pages 755 ff.

2-Aminoalkyl-imidazole compounds of the general Formula (VIII) are likewise known from the prior art. They can be manufactured using well established synthetic organic processes. A viable synthesis is described for example in Tetrahedron 2005, vol. 61, on pages 11148 to 11155.

Specific benzoxazine compounds of the general Formula (V) can be selected for example from the following compounds:

(B-IX)

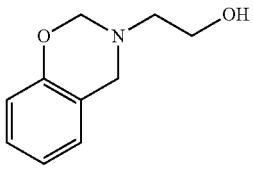

(B-X)

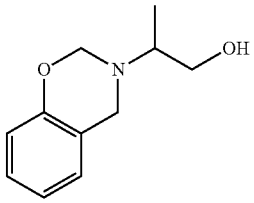

(B-XI)

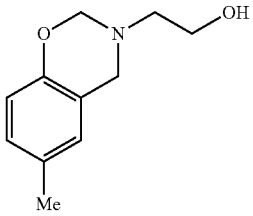

(B-XII)

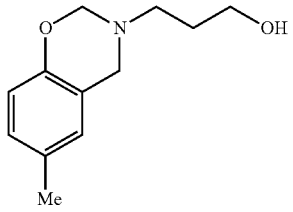

(B-XIII)

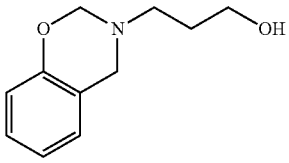

(B-XIV)

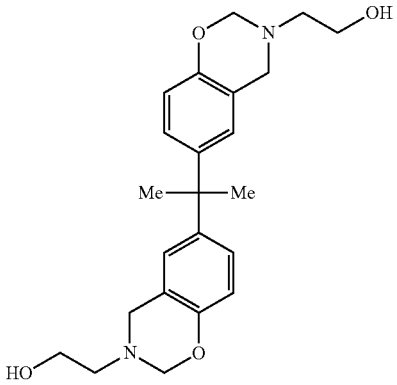

-continued (B-XV)

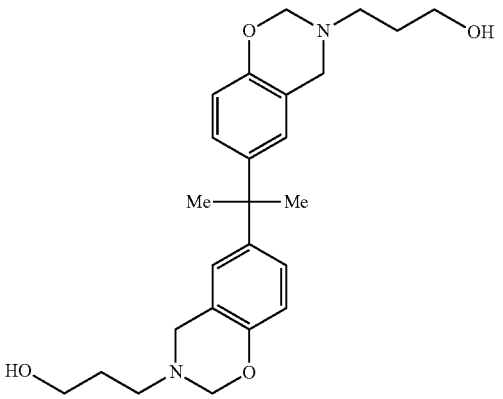

(B-XVI)

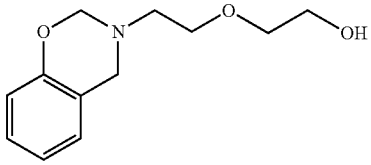

(B-XVII)

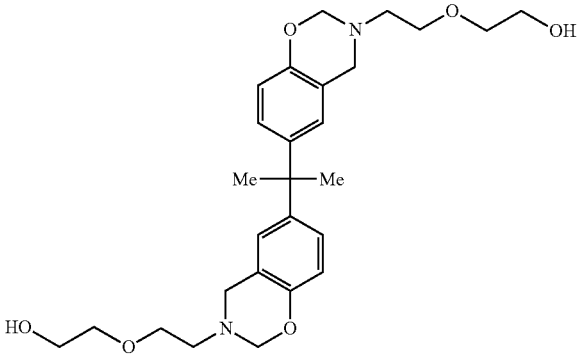

The illustrated benzoxazine compounds that carry a free hydroxyl group can be manufactured by treating a phenolic compound with an aldehyde, such as for example formaldehyde, and an amino alcohol. The reaction time can vary from several minutes up to several hours. Suitable amino alcohols, such as for example 2-aminoethanol, 3-amino-1-propanol, amino-2-propanol, 4-amino-1-butanol, 2-amino-1-butanol, 4-amino-2-butanol, 5-amino-1-pentanol, 6-amino-1-hexanol, 7-amino-1-heptanol, 3-amino-1,2-propanediol, 2-(2-aminoethoxy)ethanol and 2-amino-1,3-propanediol are commercially available and can be obtained for example from Sigma-Aldrich or Tokyo Chemical Industry.

The polymerizable benzoxazine compounds can be used both alone as well as in any possible combination for the manufacture of the inventively used benzoxazine polymers.

Consequently, in one embodiment of the invention, the inventively used benzoxazine polymers can be manufactured from a prepared mixture that contains

- at least one polymerizable benzoxazine compound of the general Formula (I), preferably at least one polymerizable benzoxazine compound of the general Formula (III) and
- at least one polymerizable benzoxazine compound of the general Formula (II).

The weight ratio of the at least one polymerizable benzoxazine compound of the general Formula (I) to the at least one polymerizable benzoxazine compound of the general Formula (II) in this case is preferably between 10:1 and 1:10, particularly preferably between 5:1 and 1:5 and in particular between 2:1 and 1:2, wherein a weight ratio of 1:1 can be particularly advantageous.

In a specific embodiment of the present invention, the inventively used benzoxazine polymer is manufactured from a prepared mixture that contains

- at least one polymerizable benzoxazine compound of the general Formula (I), preferably at least one polymerizable benzoxazine compound of the general Formula (III) and
- at least one polymerizable benzoxazine compound of the general Formula The weight ratio of the at least one polymerizable benzoxazine compound of the general Formula (I) to the at least one polymerizable benzoxazine compound of the general Formula (IV) in this case is preferably between 10:1 and 1:10, particularly preferably between 5:1 and 1:5 and in particular between 2:1 and 1:2, wherein a weight ratio of 1:1 can be particularly advantageous.

In another specific embodiment of the present invention, the inventively used benzoxazine polymer can be manufactured from a prepared mixture that contains

- at least one polymerizable benzoxazine compound of the general Formula (I), preferably at least one polymerizable benzoxazine compound of the general Formula (III) and
- at least one polymerizable benzoxazine compound of the general Formula (V).

The weight ratio of the at least one polymerizable benzoxazine compound of the general Formula (I) to the at least one polymerizable benzoxazine compound of the general Formula (V) in this case is preferably between 10:1 and 1:10, particularly preferably between 5:1 and 1:5 and in particular between 2:1 and 1:2, wherein a weight ratio of 1:1 can be particularly advantageous.

In another preferred embodiment of the present invention, the inventively used benzoxazine polymer can be manufactured from a prepared mixture that contains

- at least one polymerizable benzoxazine compound of the general Formula (I), preferably at least one polymerizable benzoxazine compound of the general Formula (III),
- at least one polymerizable benzoxazine compound of the general Formula (IV) and
- at least one polymerizable benzoxazine compound of the general Formula (II).

The fraction of the polymerizable benzoxazine compound of the general Formula (I) in the total amount of the polymerizable benzoxazine compounds is preferably 5 to 90 wt. %, particularly preferably 10 to 80 wt. % and quite particularly preferably 25 to 50 wt. %; the fraction of the polymerizable benzoxazine compound of the general Formula (IV) is preferably 5 to 90 wt. %, particularly preferably 10 to 80 wt. % and quite particularly preferably 25 to 50 wt. % and the fraction of the polymerizable benzoxazine compound of the general Formula (IV) is preferably 5 to 90 wt. %, particularly preferably 10 to 80 wt. % and quite particularly preferably 25 to 50 wt. %, each based on the total amount of the polymerizable benzoxazine compounds.

Moreover, it can be advantageous that besides the already described benzoxazine compounds, additional polymerizable benzoxazine compounds that differ from the abovementioned polymerizable benzoxazine compounds are used for manufacturing the inventively used benzoxazine polymer.

Suitable benzoxazine compounds are preferably described by the Formula (B-XVIII), (B-XVIII)

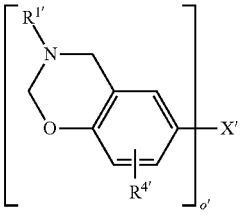

wherein o' is a whole number between 1 and 4, X' is selected from the group consisting of alkyl (for o'=1), alkylene (for o'=2 to 4), oxygen (for o'=2), thiol (for o'=1), sulfur (for o'=2), sulfoxide (for o'=2), sulfone (for o'=2) and a direct, covalent bond (for o=2), $R^{1'}$ is selected from the group consisting of hydrogen, alkyl, alkenyl and aryl and $R^{4'}$ is selected from the group consisting of hydrogen, halogen, alkyl and alkenyl, or $R^{4'}$ is a divalent group that makes a corresponding naphthoxazine structure from the benzoxazine structure.

Preferred benzoxazine compounds are in addition compounds of the general formula (B-IXX), (B-IXX)

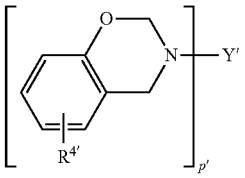

wherein p'=2 and Y' is selected from the group consisting of biphenyl, diphenylmethane, diphenylisopropane, diphenyl sulfide, diphenyl sulfoxide, diphenyl sulfone, diphenyl ketone and $R^{4'}$ is selected from the group consisting of hydrogen, halogen, alkyl and alkenyl, or $R^{4'}$ is a divalent group that makes a corresponding naphthoxazine structure from the benzoxazine structure.

Likewise preferred benzoxazine compounds are in addition compounds of the general formula (B-XX) to (B-XXII), (B-XX)

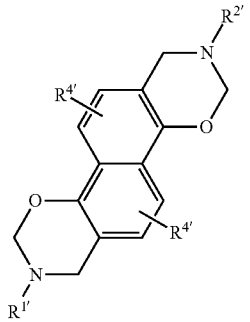

-continued (B-XXI)

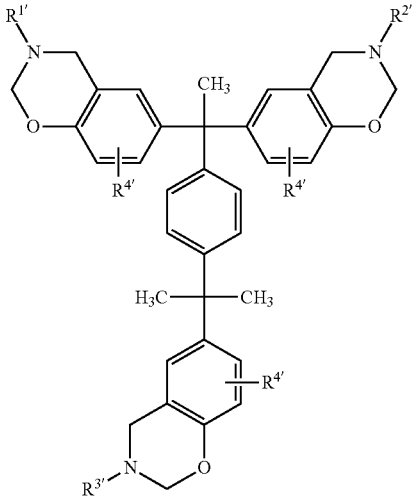

(B-XXII)

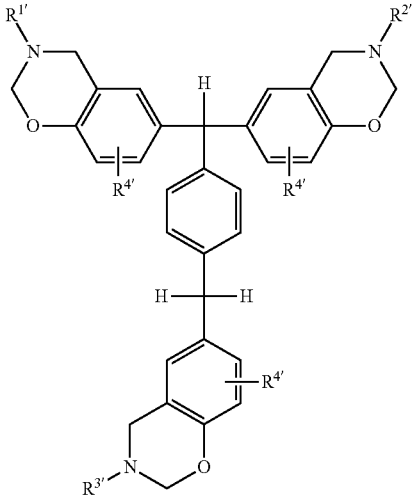

wherein $R^{1'}$ and $R^{4'}$ are as defined above and $R^{3'}$ and $R^{2'}$ are defined like $R^{1'}$.

The illustrated benzoxazine compounds are commercially available and are marketed inter alia by Huntsman Advanced Materials; Georgia-Pacific Resins, Inc. and Shikoku Chemicals Corporation, Chiba, Japan. Notwithstanding this, the benzoxazine compounds can also be obtained by treating a phenolic compound, for example Bisphenol A, Bisphenol F, Bisphenol S or thiophenol with an aldehyde, for example formaldehyde, in the presence of a primary amine. Suitable manufacturing processes are described for example in U.S. Pat. No. 5,543,516, in particular disclosed in the examples 1 to 19 in columns 10 to 14, wherein the reaction time of the relevant reaction can take some minutes to some hours, depending on the concentration, reactivity and reaction temperature.

The structure of the inventively used benzoxazine polymer is linear or branched depending on the choice of the benzoxazine compounds. Linear structures are preferred due to their high water-solubility and their good capacity for interaction with a large number of surfaces. The weight average molecular weight "$M_W$," of the inventively used benzoxazine polymers is preferably between 500 and 100 000 g/mol, particularly preferably between 1000 and 100 000 g/mol and quite particularly preferably between 3000 and 50 000 g/mol. In this regard the weight average molecular weight can be measured by means of gel permeation chromatography (GPC) with a polystyrene standard.

The benzoxazine polymers that are obtainable by polymerizing the benzoxazine compounds are used inventively as such as color transfer inhibitors. The cationic benzoxazine polymers that are obtained from them by treatment with at least one alkylating agent are also usable. The alkylation can be carried out with methods known per se. For this, the relevant alkylating agent or a mixture of different alkylating agents is added to the benzoxazine polymer that is present either as a pure substance or as a solution or as a dispersion or emulsion. The reaction can be effected in alcoholic solution, for example in ethanol or isopropanol, wherein it is likewise possible to work in the presence of inert emulsifiers or dispersants. In this regard, the relevant reaction conditions and the quantity of alkylating agent are preferably chosen, such that at least 5% of all nitrogen atoms, based on the total number of all nitrogen atoms in the benzoxazine polymer, are converted into permanently quaternary nitrogen atoms. In particular, the relevant reaction conditions and the quantity of alkylating agent are chosen, such that at least 10%, or at least 15%, or at least 20%, or at least 25%, or at least 30%, or at least 35%, or at least 35%, or at least 40%, or at least 45%, or at least 50%, or at least 55%, or at least 60%, or at least 65%, or at least 70%, or at least 75%, or at least 80%, or at least 85%, or at least 90%, or at least 95% of all nitrogen atoms are converted into permanently quaternary nitrogen atoms. In this context, preferably alkyl halides, dialkyl sulfates, dialkyl carbonates and alkylene oxides, such as for example ethylene oxide—the last in the presence of dialkyl phosphates, come into consideration as the alkylating agent. The alkylation is preferably effected with methyl iodide and/or dialkyl sulfates. In the context of the present invention, benzoxazine polymers containing permanently quaternary nitrogen atoms are referred to as cationic benzoxazine polymers.

The desired color transfer inhibiting effect also results, apart from in the washing process in the strictest sense, when the above defined polymers that are obtainable by polymerizing benzoxazines are brought into contact with the textile in a washing conditioning step, for example as a component of a rinse softener, and the thus-treated textile is washed in the presence of differently colored washing in the next washing process that can be implemented with an agent comprising the inventively used polymer or with an agent that is free of it.

Consequently, another subject matter of the invention is a color-protecting cleaning or washing agent or washing conditioner, comprising a color transfer inhibitor in the form of an above defined polymer.

An inventive agent preferably comprises 0.01 wt. % to 10 wt. %, particularly 0.1 wt. % to 1 wt. % of the cited polymer.

The inventively used polymers make a contribution in both of the previously broached aspects of color consistency, i.e. they reduce both discoloration as well as fading, the effect of the prevention of staining being the most pronounced, in particular when white textiles are washed. Consequently, another subject matter of the invention is the use of a suitable polymer in order to avoid changes of the color impression of textiles when they are washed in particular, in surfactant-containing aqueous solutions. The changes in the color impression is not to be understood as the difference between soiled and clean textile, but rather as the color difference between each clean textile before and after the washing process.

Another subject matter of the invention is a process for washing dyed textiles in surfactant-containing aqueous solutions, wherein in said process a surfactant-containing solution is employed that comprises an above defined polymer. In a process of this type it is also possible to wash white and un-dyed textiles together with the dyed textile, without the white or un-dyed textile becoming stained. The color transfer inhibiting action of the inventively used polymer is particularly pronounced when washing cotton textiles, wherein the type of textile refers to the white or un-dyed textile. In addition, the color transfer inhibiting action of the inventively used polymer is particularly pronounced when washing textiles that are dyed with substantive, reactive or acid dyes.

In addition to the polymer that is obtainable by polymerizing benzoxazines, an inventive agent can, if desired, additionally comprise a known color transfer inhibitor, preferably in amounts of 0.01 wt. % to 5 wt. %, in particular 0.1 wt. % to 1 wt. %, which in a preferred development of the invention is a polymer or a copolymer of vinyl pyrrolidone, vinylimidazole, vinylpyridine N-oxide. N-Polyvinyl pyrrolidones N-vinylimidazol/N-vinyl pyrrolidone copolymers, polyvinyloxazolidones, copolymers based on vinyl monomers and carboxylic acid amides, pyrrolidone group-containing polyesters and polyamides, grafted polyamido amines and polyethylene imines, polymers with amide groups of secondary amines, polyamine N-oxide polymers, polyvinyl alcohols and copolymers based on acrylamido alkenyl sulfonic acids are all suitable. However, enzymatic systems, which include a peroxidase and hydrogen peroxide or a substance that releases hydrogen peroxide in water, can also be added. The addition of a mediator compound for the peroxidase, for example, an acetosyringone, a phenol derivative or a phenothiazine or phenoxazine is preferred in this case, wherein in addition, the above-mentioned polymeric color transfer inhibitor active substances can also be used. Among the copolymers that are suitable additional color transfer inhibitors, those of vinyl pyrrolidone and vinylimidazole in the molar ratio 5:1 to 1:1 are preferred.

The inventive washing agents, which can be present in particular as powdery solids, in the form of post-compacted particles, as homogeneous solutions or suspensions, can comprise in principle all known and customary ingredients for such agents in addition to the inventively employed active substance. In particular, the inventive agents can comprise builders, surface-active surfactants, bleaching agents based on organic and/or inorganic peroxy compounds, bleach activators, water-miscible organic solvents, enzymes, sequestrants, electrolytes, pH regulators and further auxiliaries such as optical brighteners, graying inhibitors, foam regulators as well as colorants and fragrances.

The inventive agents can comprise one or more surfactants, wherein particularly anionic surfactants, non-ionic surfactants and their mixtures, but also cationic, zwitterionic and amphoteric surfactants come into question.

Suitable non-ionic surfactants are particularly alkyl glycosides and ethoxylation and/or propoxylation products of alkyl glycosides or linear or branched alcohols, each with 12 to 18 carbon atoms in the alkyl moiety and 3 to 20, preferably 4 to 10 alkyl ether groups. Moreover, corresponding ethoxylation and/or propoxylation products of N-alkylamines, vicinal diols, fatty acid esters and fatty acid amides, which in regard to the alkyl moiety correspond to the cited long chain alcohol derivatives, as well as alkyl phenols with 5 to 12 carbon atoms in the alkyl group can be used.

Preferred non-ionic surfactants are alkoxylated, advantageously ethoxylated, particularly primary alcohols preferably containing 8 to 18 carbon atoms and, on average, 1 to 12 moles of ethylene oxide (EO) per mole of alcohol, in which the alcohol group may be linear or, preferably methyl-branched in the 2-position, or may contain linear and methyl-branched groups in the form of the mixtures typically present in oxo alcohol groups. Particularly preferred are, however, alcohol ethoxylates with linear groups from alcohols of natural origin with 12 to 18 carbon atoms, e.g. from coco-, palm-, tallow- or oleyl alcohol, and an average of 2 to 8 EO per mol alcohol. Exemplary preferred ethoxylated alcohols include C12-14 alcohols with 3 EO or 4EO, $C_{9-11}$ alcohols with 7 EO, $C_{13-15}$ alcohols with 3 EO, 5 EO, 7EO or 8 EO, $C_{12-18}$ alcohols with 3 EO, 5 EO or 7 EO and mixtures thereof, such as mixtures of $C_{12-14}$ alcohol with 3 EO and $C_{12-18}$ alcohol with 7 EO. The cited degrees of ethoxylation constitute statistically average values that can be a whole or a fractional number for a specific product. Preferred alcohol ethoxylates have a narrowed homolog distribution (narrow range ethoxylates, NRE). In addition to these non-ionic surfactants, fatty alcohols with more than 12 EO can also be used. Examples of these are (tallow) fatty alcohols with 14 EO, 16 EO, 20 EO, 25 EO, 30 EO or 40 EO. Extremely low foaming compounds are usually used in agents employed in automatic processes. They preferably include $C_{12}$-$C_{18}$ alkyl polyethylene glycol-polypropylene glycol ethers containing up to 8 moles of each of ethylene oxide and propylene oxide units in the molecule. Other known low foaming non-ionic surfactants can also be used, such as for example $C_{12}$-$C_{18}$ alkyl polyethylene glycol polybutylene glycol ethers containing up to 8 moles of each of ethylene oxide and butylene oxide units in the molecule, as well as end-blocked alkyl polyalkylene glycol mixed ethers. Hydroxyl group-containing alkoxylated alcohols, the so-called hydroxyl mixed ethers, are also particularly preferred. The non-ionic surfactants also include alkyl glycosides that satisfy the general Formula $RO(G)_x$, in which R means a primary linear or methyl-branched, particularly 2-methyl-branched, aliphatic group containing 8 to 22 and preferably 12 to 18 carbon atoms and G stands for a glycose unit containing 5 or 6 carbon atoms, preferably glucose. The degree of oligomerization x, which defines the distribution of monoglycosides and oligoglycosides, is any number—that as an analytically determined parameter can also assume fractional values—between 1 and 10, preferably between 1.2 and 1.4.

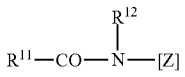

in which $R^{11}CO$ stands for an aliphatic acyl group with 6 to 22 carbon atoms, $R^{12}$ for hydrogen, an alkyl or hydroxyalkyl group with 1 to 4 carbon atoms and [Z] for a linear or branched polyhydroxyalkyl group with 3 to 10 carbon atoms and 3 to 10 hydroxyl groups. The polyhydroxyfatty acid amides are advantageously derived from reducing sugars having 5 or 6 carbon atoms, especially from the glucoses.

The group of the polyhydroxyfatty acid amides also includes compounds corresponding to the Formula

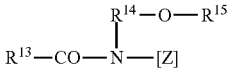

in which $R^{13}$ stands for a linear or branched alkyl or alkenyl group comprising 7 to 12 carbon atoms, $R^{14}$ for a linear, branched or cyclic alkylene group or an arylene group comprising 2 to 8 carbon atoms and $R^{15}$ for a linear, branched or cyclic alkyl group or an aryl group or an oxyalkyl group comprising 1 to 8 carbon atoms, $C_{1-4}$ alkyl or phenyl groups being preferred, and Z for a linear polyhydroxyalkyl group, of which the alkyl chain is substituted by at least two hydroxyl groups, or alkoxylated, preferably ethoxylated or propoxylated derivatives of that group. [Z] is preferably obtained by reductive amination of a sugar such as glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst. Another class of preferred non-ionic surfactants which may be used, either as the sole non-ionic surfactant or in combination with other non-ionic surfactants, in particular together with alkoxylated fatty alcohols and/or alkyl glycosides, are alkoxylated, preferably ethoxylated or ethoxylated and propoxylated fatty acid alkyl esters preferably containing 1 to 4 carbon atoms in the alkyl chain, in particular fatty acid methyl esters. Non-ionic surfactants of the amine oxide type, for example N-cocoalkyl-N,N-dimethylamine oxide and N-tallow alkyl-N,N-dihydroxyethylamine oxide, and the fatty acid alkanolamides may also be suitable. The quantity in which these non-ionic surfactants are used is preferably no more than the quantity in which the ethoxylated fatty alcohols are used and, particularly no more than half that quantity. The so-called gemini surfactants can be considered as further surfactants. Generally speaking, such compounds are understood to mean compounds that have two hydrophilic groups and two hydrophobic groups per molecule. As a rule, these groups are separated from one another by a "spacer". The spacer is usually a hydrocarbon chain that is intended to be long enough such that the hydrophilic groups are a sufficient distance apart to be able to act independently of one another. These types of surfactants are generally characterized by an unusually low critical micelle concentration and the ability to strongly reduce the surface tension of water. In exceptional cases, the term gemini surfactants is understood to mean not only such "dimeric surfactants", but also the corresponding "trimeric surfactants". Suitable exemplary Gemini surfactants are sulfated hydroxyl mixed ethers or dimer alcohol bis- and trimer alcohol tris-sulfates and -ether sulfates. End blocked dimeric and trimeric mixed ethers are particularly characterized by their di and multifunctionality. Thus, the cited end blocked surfactants possess good wetting properties and are also low foaming, such that they are particularly suited for use in automatic washing or cleaning processes. However, gemini polyhydroxy fatty acid amides or poly polyhydroxy fatty acid amides can also be used. Sulfuric acid mono esters derived from straight-chained or branched $C_7$-$C_{21}$ alcohols ethoxylated with 1 to 6 moles ethylene oxide are also suitable, for example 2-methyl-branched $C_9$-$C_{11}$ alcohols with an average of 3.5 mole ethylene oxide (EO) or $C_{12}$-$C_{18}$ fatty alcohols with 1 to 4 EO. The preferred anionic surfactants also include the salts of alkylsulfosuccinic acid, which are also referred to as sulfosuccinates or esters of sulfosuccinic acid and the monoesters and/or diesters of sulfosuccinic acid with alcohols, preferably fatty alcohols and especially ethoxylated fatty alcohols. Preferred sulfosuccinates comprise $C_8$ to $C_{18}$ fatty alcohol groups or mixtures of them. Especially preferred sulfosuccinates contain a fatty alcohol group derived from the ethoxylated fatty alcohols that are under consideration as non-ionic surfactants. Once again the particularly preferred sulfosuccinates are those, whose fatty alcohol groups are derived from ethoxylated fatty alcohols with narrow range homolog distribution. It is also possible to use alk(en)ylsuccinic acids with preferably 8 to 18 carbon atoms in the alk(en)yl chain, or salts thereof. Fatty acid derivatives of amino acids, for example N-methyltaurine (taurides) and/or N-methylglycine can be considered as further anionic surfactants. The sarcosides or the sarcosinates and here, above all the sarcosinates of higher and optionally mono or polyunsaturated fatty acids such as oleyl sarcosinate are especially preferred. Soaps in particular can be considered as further anionic surfactants. Saturated fatty acid soaps are suitable, such as the salts of lauric acid, myristic acid, palmitic acid, stearic acid, hydrogenated erucic acid and behenic acid, and especially soap mixtures derived from natural fatty acids such as coconut oil fatty acid, palm kernel oil fatty acid or tallow fatty acid. The known alkenyl succinic acid salts can also be used together with these soaps or instead of soaps.

The anionic surfactants, including the soaps, may be in the form of their sodium, potassium or ammonium salts or as soluble salts of organic bases, such as mono, di or triethanolamine. Preferably, the anionic surfactants are in the form of their sodium or potassium salts, especially in the form of the sodium salts.

Cationic surfactants that are especially employed in inventive washing conditioners are preferably selected from the esterquats and/or the quaternary ammonium compounds (QUATS) according to the general formula $(R^{I})(R^{II})(R^{III})(R^{IV})N^{+}X^{-}$, in which $R^{I}$ to $R^{IV}$ may be the same or different $C_{1-22}$ alkyl groups, $C_{7-28}$ arylalkyl groups or heterocyclic groups, wherein two or—in the case of an aromatic bonding, such as in pyridine—even three groups together with the nitrogen atom form the heterocycle, for example a pyridinium or imidazolinium compound, and $X^{-}$ represents halide ions, sulfate ions, hydroxide ions or similar anions. QUATS can be obtained by reacting tertiary amines with alkylating agents such as, for example, methyl chloride, benzyl chloride, dimethyl sulfate, dodecyl bromide but also ethylene oxide. The alkylation of tertiary amines having one long alkyl chain and two methyl groups is particularly easy. The quaternization of tertiary amines containing two long chains and one methyl group can also be carried out under mild conditions using methyl chloride. Amines containing three long alkyl chains or hydroxy-substituted alkyl chains lack reactivity and are quaternized with dimethyl sulfate, for example. Suitable QUATS are, for example, Benzalkonium chloride (N-alkyl-N,N-dimethylbenzylammonium chloride, Benzalkon B (m,p-dichlorobenzyl dimethyl-$C_{12}$-alkylammonium chloride, Benzoxonium chloride (benzyldodecyl-bis-(2-hydroxyethyl) ammonium chloride), Cetrimonium bromide (N-hexadecyl-N,N-trimethylammonium bromide, Benzetonium chloride (N,N-di-methyl-N-[2-[2-[p-(1,1,3,3-tetramethylbutyl)-phenoxy]ethoxy]-ethyl]-benzylammonium chloride, dialkyldimethylammonium chlorides, such as di-n-decyldimethylammonium chloride, didecyldimethylammonium bromide, dioctyldimethylammonium chloride, 1-cetylpyridinium chloride and thiazoline iodide and mixtures thereof. Preferred QUATS are the benzalkonium chlorides containing $C_{8-22}$ alkyl groups, more particularly $C_{12-14}$ alkylbenzyldimethylammonium chloride.

Among esterquats should here be understood compounds of the general formula,

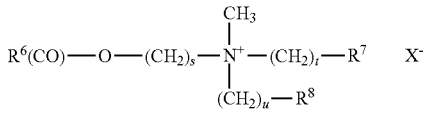

in which $R^{6}$ stands for an alkyl or alkenyl group containing 12 to 22 carbon atoms and 0, 1, 2 or 3 double bonds, $R^{7}$ and $R^{8}$ independently of one another stand for H, OH or $O(CO)R^{6}$, s, t and u each independently of one another stands for the value 1, 2 or 3 and $X^{-}$ stands for an anion, in particular halide, methosulfate, methophosphate or phosphate as well as mixtures thereof. Preferred compounds comprise a group $O(CO)R^{5}$ for $R^{7}$ and an alkyl group with 16 to 18 carbon atoms for $R^{6}$. Particularly preferred are compounds in which in addition $R^{8}$ stands for OH. Examples of compounds of the cited formula are methyl-N-(2-hydroxyethyl)-N,N-di(tallowacyloxyethyl)ammonium methosulfate, bis(palmitoyl)-ethylhydroxyethylmethylammonium methosulfate or methyl-N,N-bis(acyloxyethyl)-N-(2-hydroxyethyl)ammonium methosulfate. When quaternized compounds are used that contain unsaturated group, the acyl groups are preferred, whose corresponding fatty acids have an iodine number between 5 and 80, preferably between 10 and 60 and in particular between 15 and 45, and/or which have a cis/trans isomer ratio (in mol %) of greater than 30:70, preferably greater than 50:50 and particularly greater than 70:30. Commercial examples are the methylhydroxyalkyldialcoyloxyalkylammonium metho sulfates marketed by the Stepan company under the trade name Stepantex® or known products from Cognis Deutschland GmbH with the trade name Dehyquart® or the known products manufactured by Goldschmidt-Witco under the name Rewoquat®.

Surfactants are comprised in the compositions according to the invention preferably in amounts of 5 wt. % to 50 wt. %, particularly 8 wt. % to 30 wt. %.

An inventive agent preferably comprises at least one water-soluble and/or water-insoluble organic and/or inorganic builder. The water-insoluble organic builders include polycarboxylic acids, particularly citric acid and sugar acids, monomeric and polymeric amino polycarboxylic acids, particularly methyl glycine diacetic acid, nitrilotriacetic acid and ethylenediamine tetraacetic acid as well as polyaspartic acid, polyphosphonic acids, particularly amino tris(methylene phosphonic acid), ethylenediaminetetrakis(methylene phosphonic acid) and 1-hydroxyethane-1,1-diphosphonic acid, polymeric hydroxyl compounds such as dextrin as well as polymeric (poly)carboxylic acids, particularly those polycarboxylates obtained from the oxidation of polysaccharides, polymeric acrylic acids, methacrylic acids, maleic acids and mixed polymers thereof, which can also comprise small amounts of polymerizable substances exempt from carboxylic acid functionality. The relative molecular weight of the homopolymers of unsaturated carboxylic acids lies generally between 3000 and 200 000, that of the copolymers between 2000 and 200 000, preferably 30 000 to 120 000, each based on free acid. A particularly preferred acrylic acid-maleic acid copolymer has a relative molecular weight of 30 000 to 100 000. Exemplary, commercially available products are Sokolan® CP 5, CP 10 and PA 30 from BASF. Suitable, yet less preferred compounds of this class, are copolymers of acrylic acid or methacrylic acid with vinyl ethers, such as vinyl methyl ether, vinyl esters, ethylene, propylene and styrene, in which the content of the acid is at least 50 wt. %. Terpolymers, which comprise two unsaturated acids and/or their salts as monomers as well as vinyl alcohol and/or an esterified vinyl alcohol or a carbohydrate as the third monomer, can also be used as water-soluble organic builders. The first acid monomer or its salt is derived from a monoethylenically unsaturated $C_{3}$-$C_{8}$ carboxylic acid and preferably from a $C_{3}$-$C_{4}$ monocarboxylic acid, particularly from (meth) acrylic acid. The second acidic monomer or its salt can be a derivative of a $C_{4}$-$C_{8}$ dicarboxylic acid, maleic acid being particularly preferred, and/or a derivative of an allyl sulfonic acid, which is substituted in the 2-position with an alkyl or aryl group. These types of polymer generally have a relative molecular weight between 1000 and 200 000. Further preferred copolymers are those, which preferably contain acrolein and acrylic acid/acrylic acid salts or vinyl acetate as monomers. The organic builders, especially for the manufacture of liquid agents, can be added in the form of aqueous solutions, preferably in the form of 30 to 40 weight percent aqueous solutions. In general, all the cited acids are added in the form of their water-soluble salts, particularly their alkali metal salts.

These types of organic builders can be comprised as desired in amounts of up to 40 wt. %, particularly up to 25 wt. % and preferably from 1 wt. % to 8 wt. %. Amounts close to the cited upper limit are preferably added in pasty or liquid, particularly aqueous, inventive agents.

The water-soluble inorganic builders particularly concern alkali metal silicates, alkali metal carbonates and alkali metal phosphates that can be present in the form of their alkaline, neutral or acidic sodium or potassium salts. Examples of these are trisodium phosphate, tetrasodium phosphate, disodium hydrogen diphosphate, pentasodium phosphate, so-called sodium hexametaphosphate, oligomeric trisodium phosphate with oligomerization degrees of 5 to 1000, particularly 5 to 50, as well as the corresponding potassium salts or mixtures of sodium and potassium salts. In particular, crystalline or amorphous alkali metal aluminosilicates in amounts of up to 50 wt. %, preferably not more than 40 wt. % and in liquid agents not more than 1 wt. % to 5 wt. % are added as the water-insoluble, water-dispersible inorganic builders. Among these, the washing agent-quality crystalline sodium aluminosilicates, especially zeolite A, P and optionally X, alone or in mixtures, for example in the form of a co-crystallisate of the zeolites A and X (Vegobond® AX, a commercial product of Condea Augusta S.p.A.) are preferred. Amounts close to the cited upper limit are preferably incorporated in solid, particulate agents. Suitable aluminosilicates particularly exhibit no particles with a particle size above 30 μm and preferably consist to at least 80 wt. % of particles smaller than 10 μm. Their calcium binding capacity, which can be determined according to the indications of German patent DE 24 12 837, generally lies in the range 100 to 200 mg CaO per gram.

Suitable substitutes or partial substitutes for the cited alumosilicate are crystalline alkali metal silicates that can be alone or present in a mixture with amorphous silicates. The alkali metal silicates that can be used as builders in the inventive agents preferably have a molar ratio of alkali metal oxide to $SiO_2$ below 0.95, particularly 1:1.1 to 1:12 and can be amorphous or crystalline. Preferred alkali metal silicates are the sodium silicates, particularly the amorphous sodium silicates, with a molar ratio $Na_2O:SiO_2$ of 1:2 to 1:2.8. Crystalline silicates that can be present alone or in a mixture with amorphous silicates are preferably crystalline, layered silicates corresponding to the general formula $Na_2Si_xO_{2x+1}yH_2O$, wherein x, the so-called module, is a number from 1.9 to 22, especially 1.9 to 4 and y is a number from 0 to 33, preferred values for x being 2, 3 or 4. Preferred crystalline layered silicates are those in which x assumes the values 2 or 3 in the cited general formula. Both β- and β-sodium disilicates ($Na_2Si_2O_5.yH_2O$) are particularly preferred. Practically anhydrous crystalline alkali metal silicates of the abovementioned general formula, in which x is a number from 1.9 to 2.1 can also be manufactured from amorphous alkali metal silicates, and can be used in inventive agents. In a further preferred embodiment of the composition according to the invention, a crystalline sodium layered silicate with a module of 2 to 3 is added, as can be manufactured from sand and soda. In a further preferred embodiment of the inventive agent, crystalline sodium silicates with a module in the range 1.9 to 3.5 can be added. The crystalline layer-forming silicates of the above Formula (I) are marketed for example by Clariant GmbH (Germany) under the trade names Na-SKS, e.g. Na-SKS-1 ($Na_2Si_{22}O_{45}XH_2O$, Kenyait), Na-SKS-2 ($Na_2Si_{14}O_{29}XH_2O$, Magadiit), Na-SKS-3 ($Na_2Si_8O_{17}XH_2O$) or Na-SKS-4 ($Na_2Si_4O_9XH_2O$, Makatit). Na-SKS-5 (α-$Na_2Si_2O_5$), Na-SKS-7 (β-$Na_2Si_2O_5$, Natrosilit), Na-SKS-9 ($NaHSi_2O_5$ $3H_2O$), Na-SKS-10 ($NaHSi_2O_53H_2O$, Kanemit), Na-SKS-11 (t-$Na_2Si_2O_5$) and Na-SKS-13 ($NaHSi_2O_5$) are most notably suitable, particularly, however, Na-SKS-6 (δ-$Na_2Si_2O_5$). In a preferred development of the inventive agent, there is added a granular compound of crystalline layered silicate and citrate, of crystalline layered silicate and the above cited polymeric polycarboxylic acid, or of alkali metal silicate and alkali metal carbonate, as for example is commercially available under the trade name Nabion® 15.

Builders are preferably comprised in the inventive agents in amounts of up to 75 wt. %, particularly from 5 wt. % to 50 wt. %.

The peroxygen compounds that are optionally comprised in the inventive agents particularly include organic peracids or peracid salts of organic acids, such as phthalimidopercaproic acid, perbenzoic acid or salts of diperoxydodecanedioic acid, hydrogen peroxide and inorganic salts that liberate hydrogen peroxide under the washing conditions, such as perborate, percarbonate, persilicate and/or persulfate like Caroat®. If it is intended to use solid peroxygen compounds, then they can be used in the form of powders or pellets, which in principle can also be encapsulated by known methods. When an inventive agent comprises peroxygen compounds then the latter are present in amounts of preferably up to 50 wt. %, especially 5 wt. % to 30 wt. %. The addition of minor quantities of known bleaching agent stabilizers, such as for example phosphonates, borates or metaborates and metasilicates as well as magnesium salts such as magnesium can be useful.

Bleach activators, which can be used, are compounds which, under perhydrolysis conditions, yield aliphatic peroxycarboxylic acids having preferably 1 to 10 carbon atoms, in particular 2 to 4 carbon atoms, and/or optionally substituted perbenzoic acid. Substances, which carry O-acyl and/or N-acyl groups of said number of carbon atoms and/or optionally substituted benzoyl groups, are suitable. Preference is given to polyacylated alkylenediamines, in particular tetraacetyl ethylenediamine (TAED), acylated triazine derivatives, in particular 1,5-diacetyl-2,4-dioxohexahydro-1,3,5-triazine (DADHT), acylated glycolurils, in particular tetraacetyl glycoluril (TAGU), N-acylimides, in particular N-nonanoyl succinimide (NOSI), acylated phenol sulfonates, in particular n-nonanoyl- or isononanoyloxybenzene sulfonate (n- or iso-NOBS), carboxylic acid anhydrides, in particular phthalic anhydride, acylated polyhydric alcohols, in particular triacetin, ethylene glycol diacetate and 2,5-diacetoxy-2,5-dihydrofuran, and enol esters as well as acetylated sorbitol and mannitol or their described mixtures (SORMAN), acylated sugar derivatives, in particular pentaacetyl glucose (PAG), pentaacetyl fructose, tetraacetyl xylose and octaacetyl lactose as well as acetylated, optionally N-alkylated glucamine and gluconolactone, and/or N-acylated lactams, for example N-benzoyl caprolactam. The hydrophilically substituted acyl acetals and the acyl lactams are also preferably used. Combinations of conventional bleach activators may also be used. These types of bleach activators, in particular in the presence of the abovementioned hydrogen peroxide releasing bleaching agents, can be comprised in the usual quantity range, preferably in amounts of 0.5 wt. % to 10 wt. %, in particular 1 wt. % to 8 wt. %, based on the total agent, but are preferably totally absent when percarboxylic acid is added as the sole bleaching agent.

In addition to the conventional bleach activators or instead of them, sulfonimines and/or bleach boosting transition metal salts or transition metal complexes can be comprised as the so-called bleach catalysts.

Additionally employable enzymes in the agents can include those from the classes of the amylases, proteases, lipases, cutinases, pullulanases, hemicellulases, cellulases, oxidases, laccases and peroxidases as well as mixtures thereof. Enzymatic active materials obtained from bacterial sources or fungi such as *Bacillus subtilis, Bacillus licheniformis, Streptomyceus griseus, Humicola lanuginosa, Humicola insolens, Pseudomonas pseudoalcaligenes, Pseudomonas cepacia* or *Coprinus cinereus* are particularly suitable. The enzymes can be adsorbed on carriers and/or embedded in encapsulants, in order to protect them against premature decomposition. They are preferably comprised in the inventive washing or cleaning agents in amounts of up to 5 wt. %, particularly from 0.2 wt. % to 4 wt. %. If the inventive agent comprises protease then it preferably has a proteolytic activity in the range of about 100 PE/g to about 10 000 PE/g, especially 300 PE/g to 8000 PE/g. If a plurality of enzymes are intended to be added in the inventive agent then this can be carried out by incorporating the two or the plurality of separate enzymes or enzymes that were separately made up according to known techniques or by incorporating two or more enzymes made up together in a granulate.

Besides water, organic solvents that can be employed in the inventive agents, particularly when the agents are in liquid or paste form, include alcohols with 1 to 4 carbon atoms, particularly methanol, ethanol, isopropanol and tert-butanol, diols with 2 to 4 carbon atoms, particularly ethylene glycol and propylene glycol, their mixtures and the ethers derived from the cited classes of compounds. These types of water-miscible solvents are preferably present in the inventive agents in amounts of not more than 30 wt. %, particularly 6 wt. % to 20 wt. %.

To adjust a pH resulting from mixing the usual components to a desired level, the inventive agents can comprise acids that are compatible with the system and the environment, particularly citric acid, acetic acid, tartaric acid, malic acid, glycolic acid, succinic acid, glutaric acid and/or adipic acid, and also mineral acids, particularly sulfuric acid or bases, particularly ammonium hydroxide or alkali metal hydroxides. These types of pH adjustors are preferably comprised in the inventive agents in amounts of not more than 20 wt. %, particularly 1.2 wt. % to 17 wt. %.

Graying inhibitors have the task of ensuring that the dirt removed from the textile fibers is held suspended in the wash liquid. Water-soluble colloids of mostly organic nature are suitable for this, for example starch, glue, gelatines, salts of ether carboxylic acids or ether sulfonic acids of starches or celluloses, or salts of acidic sulfuric acid esters of celluloses or starches. Water-soluble, acid group-containing polyamides are also suitable for this purpose. Moreover, aldehyde starches, for example, can be used instead of the abovementioned starch derivatives. Preference, however, is given to the use of cellulose ethers such as carboxymethyl cellulose (Na salt), methyl cellulose, hydroxyalkyl celluloses, and mixed ethers such as methyl hydroxyethyl cellulose, methyl hydroxypropyl cellulose, methyl carboxymethyl cellulose and mixtures thereof, which can be added, for example in amounts of 0.1 to 5 wt. %, based on the agent.

The inventive textile washing agents may contain for example derivatives of diaminostilbene disulfonic acid or alkali metal salts thereof as optical brighteners, although for use as a washing agent for coloreds, they are preferably free of optical brighteners. Suitable optical brighteners are, for example, salts of 4,4'-bis-(2-anilino-4-morpholino-1,3,5-triazinyl-6-)stilbene-2,2'-disulfonic acid or compounds of similar structure which contain a diethanolamino group, a methylamino group, an anilino group or a 2-methoxyethylamino group instead of the morpholino group. Optical brighteners of the substituted diphenylstyryl type may also be present, for example the alkali metal salts of 4,4'-bis(2-sulfostyryl)diphenyl, 4,4'-bis(4-chloro-3-sulfostyryl)diphenyl or 4-(4-chlorostyryl)-4'-(2-sulfostyryl)diphenyl. Mixtures of the abovementioned optical brighteners may also be used.

Particularly when used in automatic processes, it can be advantageous to add conventional foam inhibitors to the agents. Suitable foam inhibitors include for example, soaps of natural or synthetic origin, which have a high content of $C_{18}$-$C_{24}$ fatty acids. Suitable non-surface-active types of foam inhibitors are, for example, organopolysiloxanes and mixtures thereof with microfine, optionally silanized silica and also paraffins, waxes, microcrystalline waxes and mixtures thereof with silanized silica or bis-fatty acid alkylenediamides. Mixtures of various foam inhibitors, for example mixtures of silicones, paraffins or waxes, are also used with advantage.

Preferably, the foam inhibitors, especially silicone-containing and/or paraffin-containing foam inhibitors, are loaded onto a granular, water-soluble or dispersible carrier material. In this regard, mixtures of paraffins and bistearylethylenediamide are preferred.

The manufacture of the solid agent according to the invention presents no difficulties and can be effected by known methods, for example by spray drying or granulation, wherein enzymes and possible further heat-sensitive ingredients, such as, for example bleaching agent are optionally subsequently added separately. For manufacturing the inventive agent with an increased bulk density, particularly in the range of 650 g/l to 950 g/l, a preferred process is one with an extrusion step.

For manufacturing the inventive compositions in tablet form, which can be monophasic or multiphasic, single colored or multicolored and especially consisting of one or more layers, especially of two layers, all the ingredients—optionally for each layer—are preferably mixed together in a mixer and the mixture is compressed using conventional tablet presses, e.g. exocentric presses or rotating presses with compression forces in the range of about 50 to 100 kN, preferably 60 to 70 kN. Particularly for the case of multilayer tablets, it can be advantageous to pre-compress at least one layer. This is preferably carried out using compression forces between 5 and 20 kN, particularly 10 to 15 kN. In this way, fracture-resistant tablets are obtained without problem which nevertheless dissolve sufficiently rapidly under conditions of use; their break strength and flexural strength are normally 100 to 200 N, preferably however more than 150 N. Tablets prepared in this way preferably have a weight of 10 g to 50 g, particularly 15 g to 40 g. The tablets may be any shape—round, oval or cornered—intermediate shapes also being possible. Corners and edges are preferably rounded off. Round tablets preferably have a diameter of 30 mm to 40 mm. In particular, the size of rectangular or block shaped tablets that are predominantly introduced through the dosing device of the automatic dishwasher for example, is dependent on the geometry and the volume of said dosing device. Exemplary preferred embodiments have a footprint of (20 to 30 mm)×(34 to 40 mm), especially 26×36 mm or 24×38 mm.

Liquid or pasty inventive agents in the form of solutions in standard solvents are generally prepared by a simple mixing of the ingredients, which can be added in the substance or as a solution into an automatic mixer.

EXAMPLES

Example 1

Preparation of Polymerizable Benzoxazine Compounds Using Jeffamines

The preparation of various polymerizable benzoxazine compounds of the Formula (B-Box-I) is described below (B-Box-I)

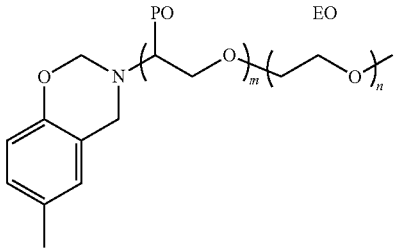

1.1 Preparation of a Polymerizable Benzoxazine Compound with the Use of Jeffamin M2070 (PO/EO 10/31); Designation (B-Box-I-1.1)

Starting Materials:

| | | |
|---|---|---|
| 9.38 g | Paraformaldehyd (96% conc.) in 50 ml Ethyl acetate | 0.30 mol |
| 309.9 g | Jeffamin M2070 (Huntsman) in 200 ml Ethyl acetate | 0.15 mol |
| 16.22 g | p-cresol in 50 ml Ethyl acetate | 0.15 mol |

The p-cresol, dissolved in ethyl acetate, was added drop wise over a period of 10 minutes to the solution of paraformaldehyde in ethyl acetate. Jeffamin M-2070 was then added over a period of 30 minutes, the temperature being maintained below 10° C. After stirring for 10 minutes, the reaction mixture was heated under reflux for 6 h. After cooling, the reaction mixture was filtered and the solvent together with any formed water were removed under vacuum. 318.90 g of the corresponding polymerizable benzoxazine compound was obtained.

1.2 Preparation of a Polymerizable Benzoxazine Compound with the Use of Jeffamin M 1000 (PO/EO 3/19); Designation (B-Box-I-1.2)

Starting Materials:

| | | |
|---|---|---|
| 18.7 g | Paraformaldehyd (96% conc.) in 50 ml Ethyl acetate | 0.60 mol |
| 312.9 g | Jeffamin M1000 (Huntsman) in 250 ml Ethyl acetate | 0.30 mol |
| 32.44 g | p-cresol in 60 ml Ethyl acetate | 0.30 mol |

Paraformaldehyde, p-cresol and Jeffamin M-1000 were reacted under the conditions described in example 1.1. 352.57 g of the corresponding polymerizable benzoxazine compound B-Box-I-1.2 was obtained.

1.2 Preparation of a Polymerizable Benzoxazine Compound with the Use of N-(3-Aminopropyl)Imidazole The Preparation Of a Polymerizable Benzoxazine Compound Of The Formula (B-Box-II) is described below:

(B-Box-II)

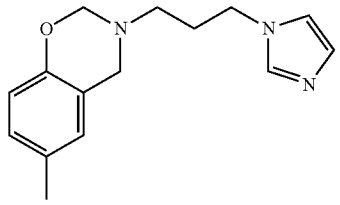

Starting Materials:

| | | |
|---|---|---|
| 78.20 g | Paraformaldehyd (96% conc.) in 100 ml Ethyl acetate | 2.50 mol |
| 157.5 g | N-(3-aminopropyl)-imidazole (Lupragen ® API) in 10 ml ethyl acetate | 1.25 mol |
| 135.17 g | p-cresol in 100 ml Ethyl acetate | 1.25 mol |

Paraformaldehyde, p-cresol and Lupragen® API (BASF SE) were reacted under the conditions described in example 1.1. The yield of the corresponding polymerizable benzoxazine compound B-Box-II was 322.74 g.

1.3 Preparation of a Polymerizable Benzoxazine Compound with the Use of Ethanolamine The preparation of a polymerizable benzoxazine compound of the Formula (B-Box-III) is described below:

(B-Box-III)

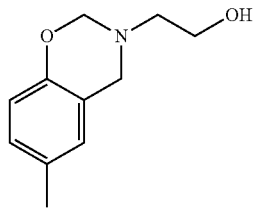

Starting Materials:

| | | |
|---|---|---|
| 106.35 g | Paraformaldehyd (96% conc.) in 100 ml Ethyl acetate | 3.40 mol |
| 103.87 g | ethanolamine in 30 ml Ethyl acetate | 1.70 mol |
| 183.84 g | p-cresol in 80 ml Ethyl acetate | 1.70 mol |

Paraformaldehyde, p-cresol and ethanolamine were reacted under the conditions described in example 1.1. The yield of the corresponding polymerizable benzoxazine compound B-Box-III was 328.6 g.

Example 2

Polymerization for Preparing Non-Cationic Benzoxazine Polymers

The above described polymerizable benzoxazine compounds were thermally cured as mixtures or individually in molds in an air circulating drying oven for a period of 2 h at 180° C. The samples were then removed from the molds and cooled down to room temperature. In this way benzoxazine polymers were prepared in the compositions shown in Table 1.

TABLE 1

| The fraction of the respective polymerizable benoxazine compounds in the benzoxazine polymer | | | | |
|---|---|---|---|---|
| | Weight fraction of the relevant polymerizable benzoxazine compounds in % | | | |
| Polymer | B-Box-I-1.2 | B-Box-I-1.1 | B-Box-II | B-Box-III |
| 1 | 100 | | | |
| 2 | | 100 | | |
| 3 | | | 100 | |
| 4 | | | | 100 |
| 5 | | 30 | | 70 |
| 6 | | 50 | | 50 |
| 7 | 30 | | | 70 |
| 8 | 50 | | | 50 |
| 9 | | 30 | 70 | |
| 10 | | 50 | 50 | |
| 11 | 70 | | 30 | |
| 12 | 50 | | 50 | |
| 13 | | 30 | 35 | 35 |
| 14 | | 50 | 25 | 25 |
| 15 | 30 | | 35 | 35 |
| 16 | 50 | | 25 | 25 |

Example 3

Alkylation of Benzoxazine Polymers for Preparing Cationic Benzoxazine Polymers 3.1 Alkylation of the Non-Cationic Benzoxazine Polymer 3 with Dimethyl Sulfate for Preparing the Cationic Benzoxazine Polymer Alk-3

26.3 g of dimethyl sulfate was slowly added with stirring to 28.0 g of the benzoxazine polymer of example 2 (100 wt. % B-Box-II) in 60 ml ethanol. After further stirring for 10 minutes, the reaction mixture was heated under reflux for 3.5 h. The reaction mixture was then stirred under a nitrogen atmosphere for 4 days at 22° C. and then poured into 600 ml diethyl ether. The precipitate was separated and dried under a vacuum in a vacuum drying oven at 80° C. for 24 h. The yield of the cationic benzoxazine polymer alk-3 was 48.7 g. At least 5% of all nitrogen atoms, based on the total number of all nitrogen atoms in the abovementioned benzoxazine polymer, were shown by NMR spectroscopic methods to be in the form of permanently quaternary nitrogen atoms.

3.2 Alkylation of the Benzoxazine Polymer 8 with Methyl Iodide for Preparing the Cationic Benzoxazine Polymer Alk-8

A solution of 6.86 g methyl iodide in 4 ml ethanol was slowly added with stirring to 5.0 g of the non-cationic benzoxazine polymer 8 of example 2 (50 wt % B-Box-1.2 and 50 wt. % B-Box-III) in 6 ml ethanol. The reaction mixture was then stirred under a nitrogen atmosphere for 24 h at 22° C. and then poured into 60 ml diethyl ether. The precipitate was separated and dried under a vacuum in a vacuum drying oven at 120° C. for 24 h. The yield of the cationic benzoxazine polymer alk-8 was 5.2 g. At least 5% of all nitrogen atoms, based on the total number of all nitrogen atoms in the abovementioned benzoxazine polymer, were shown by NMR spectroscopic methods to be in the form of permanently quaternary nitrogen atoms.

3.3 Alkylation of the Benzoxazine Polymer 11 with Dimethyl Sulfate for Preparing the Cationic Benzoxazine Polymer Alk-11

1.9 g of dimethyl sulfate was slowly added with stirring to 10.6 g of the benzoxazine polymer 11 of example 2 (70 wt. % B-Box-1.2 and 30 wt. % B-Box-II) in 10 ml ethanol. After further stirring for 10 minutes, the reaction mixture was heated under reflux for 3.5 h. The reaction mixture was then stirred under a nitrogen atmosphere for 24 h at 22° C. and then poured into 100 ml diethyl ether. The precipitate was separated and dried under a vacuum in a vacuum drying oven at 80° C. for 24 h. The cationic benzoxazine polymer alk-11 was obtained. At least 5% of all nitrogen atoms, based on the total number of all nitrogen atoms in the abovementioned benzoxazine polymer, were shown by NMR spectroscopic methods to be in the form of permanently quaternary nitrogen atoms.

Example 4

Color Transfer Inhibition

The compositions of the inventive agent E and of a comparative example V1 are shown in the following table:

TABLE 2

| Formulation [wt. %] | | |
|---|---|---|
| | E | V1 |
| $C_{12-18}$ Fattyalcohol with 7 EO | 10 | 10 |
| Na $C_{12-18}$ Fatty alcohol with 7 EO sulfate | 14.5 | 14.5 |
| $C_{12-18}$ Fatty acid | 5 | 5 |
| Citric acid | 3 | 3 |
| Na phosphonate | 1 | 1 |
| Benzoxazine polymer (from Example 2 or 3) | 0.1 | — |
| Polyvinyl pyrrolidone | — | 0.1 |
| Sodium hydroxide | 4.5 | 4.5 |
| Propylene glycol | 9 | 9 |
| Boric acid | 1 | 1 |
| Silicone defoamer | 0.1 | 0.1 |
| Water | ad 100 | ad 100 |

In washing tests, inventive agents E that comprised a benzoxazine polymer prepared in the Examples 2 and 3, showed better color transfer inhibiting characteristics than the comparative formulation V1.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A fabric treatment agent comprising a color transfer inhibitor in the form of a polymer obtained from polymerizing benzoxazine monomers compounds, said polymer selected from compounds of the general Formula (I) or from compounds of the general Formula (II) or from mixtures thereof, Formula (I)

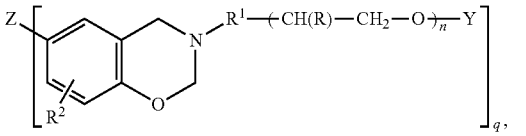

Formula (II)

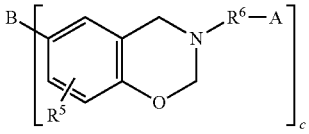

wherein q is a whole number from 1 to 4, n is a number from 2 to 20 000,

R in each repeat unit is selected independently of each other from hydrogen or linear or branched, optionally substituted alkyl groups that comprise 1 to 8 carbon atoms, Z is selected from hydrogen (for q=1), alkyl (for q=1), alkylene (for q=2 to 4), carbonyl (for q=2), oxygen (for q=2), sulfur (for q=2), sulfoxide (for q=2), sulfone (for q=2) and a direct, covalent bond (for q=2), $R^1$ stands for a covalent bond or a divalent linking group that contains 1 to 100 carbon atoms, $R^2$ is selected from hydrogen, halogen, alkyl and alkenyl, or $R^2$ is a divalent group that makes a corresponding naphthoxazine structure from the benzoxazine structure, Y is selected from linear or branched, optionally substituted alkyl groups that contain 1 to 15 carbon atoms, cycloaliphatic groups that optionally comprise one or more heteroatoms, aryl groups that optionally comprise one or more heteroatoms, and —(C═O)$R^3$, wherein $R^3$ is selected from linear or branched, optionally substituted alkyl groups containing 1 to 15 carbon atoms and X—$R^4$, wherein X is selected from S, O, and NH and $R^4$ is selected from linear or branched optionally substituted alkyl groups containing 1 to 15 carbon atoms, c is a whole number from 1 to 4, B is selected from hydrogen (for c=1), alkyl (for c=1), alkylene (for c=2 to 4), carbonyl (for c=2), oxygen (for c=2), sulfur (for c=2), sulfoxide (for c=2), sulfone (for c=2) and a direct, covalent bond (for c=2), A is a hydroxyl group or a nitrogen-containing heterocycle, $R^5$ is selected from hydrogen, halogen, alkyl and alkenyl, or $R^5$ is a divalent group that makes a corresponding naphthoxazine structure from the benzoxazine structure and $R^6$ stands for a covalent bond or is a divalent linking group that contains 1 to 100 carbon atoms, and wherein the agent additionally comprises a polymer of vinyl pyrrolidone, vinylimidazole, or vinylpyridine-N-oxide.

2. The agent according to claim 1, comprising 0.01 wt.% to 10 wt.% of the polymer.

3. The agent according to claim 1 wherein the weight average molecular weight of the benzoxazine polymer is between 500 and 100 000 g/mol.

4. The agent according to claim 1, wherein the benzoxazine compounds of the general Formula (I) are selected from compounds of the general Formula (III), Formula (III)

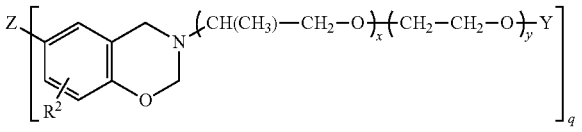

wherein x is a number between 0 and 1000 and y is a number between 0 and 1000, with the proviso that x+y≥2, wherein Z, $R^2$, Y and q are each defined as in Formula (I).

5. The agent according to claim 1, wherein the benzoxazine compounds of the general Formula (II) are selected from compounds of the general Formula (IV) and/or compounds of the general Formula (V), Formula (IV)

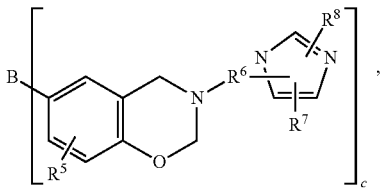

Formula (V)

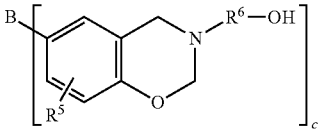

wherein $R^7$ and $R^8$ each independently of one another are selected from hydrogen, halogen, linear or branched, optionally substituted alkyl groups, alkenyl groups and aryl groups, wherein c, B, $R^5$ and $R^6$ are each as defined above as in Formula (II).

* * * * *